US008701562B2

(12) United States Patent
Severson

(10) Patent No.: US 8,701,562 B2
(45) Date of Patent: Apr. 22, 2014

(54) SIGNALING AND REMOTE CONTROL TRAIN OPERATION

(71) Applicant: QS Industries, Inc., Beaverton, OR (US)

(72) Inventor: Frederick E. Severson, Beaverton, OR (US)

(73) Assignee: QS Industries, Inc., Beaverton, OR (US)

( * ) Notice: Subject to any disclaimer, the term of this patent is extended or adjusted under 35 U.S.C. 154(b) by 0 days.

(21) Appl. No.: 13/800,232

(22) Filed: Mar. 13, 2013

(65) Prior Publication Data

US 2013/0203318 A1 Aug. 8, 2013

Related U.S. Application Data

(62) Division of application No. 13/455,417, filed on Apr. 25, 2012, now Pat. No. 8,408,143, which is a division of application No. 13/152,657, filed on Jun. 3, 2011, now Pat. No. 8,166,887, which is a division of application No. 12/176,275, filed on Jul. 18, 2008, now Pat. No. 7,954,435, which is a division of application No. 11/075,469, filed on Mar. 8, 2005, now Pat. No. 7,451,708.

(60) Provisional application No. 60/551,652, filed on Mar. 8, 2004.

(51) Int. Cl.
*A63H 19/14* (2006.01)

(52) U.S. Cl.
USPC ..... 105/26.05; 446/410; 105/238.2

(58) Field of Classification Search
USPC ..... 105/1.5, 26.05, 29.2, 157.2, 238.2; 446/409, 410; 381/349, 337, 345, 350, 381/347
See application file for complete search history.

(56) References Cited

U.S. PATENT DOCUMENTS

| | | | | |
|---|---|---|---|---|
| 2,791,972 | A * | 5/1957 | Smith | 104/296 |
| 3,600,848 | A * | 8/1971 | Marshall et al. | 446/410 |
| 4,284,279 | A * | 8/1981 | Mori | 369/63 |

* cited by examiner

*Primary Examiner* — Mark Le
(74) *Attorney, Agent, or Firm* — Stolowitz Ford Cowger LLP

(57) ABSTRACT

On-board model railroad speaker enclosure designs are presented that allow maximum sized speakers, improve impedance matching of sound to the outside of the locomotive, and isolate back and front speaker waves while maintaining the standard horizontal drive-train in model train locomotives.

3 Claims, 13 Drawing Sheets

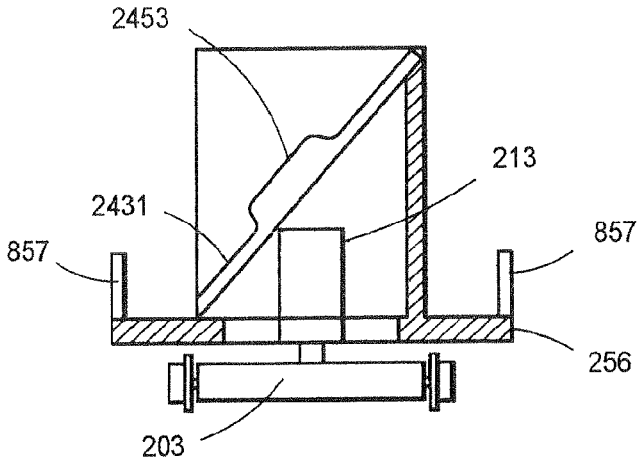
FIG.24
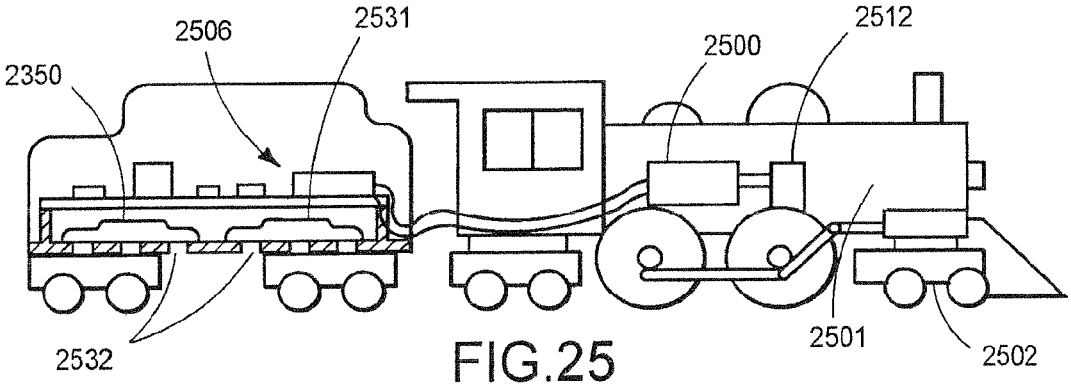
FIG.25
Prior Art
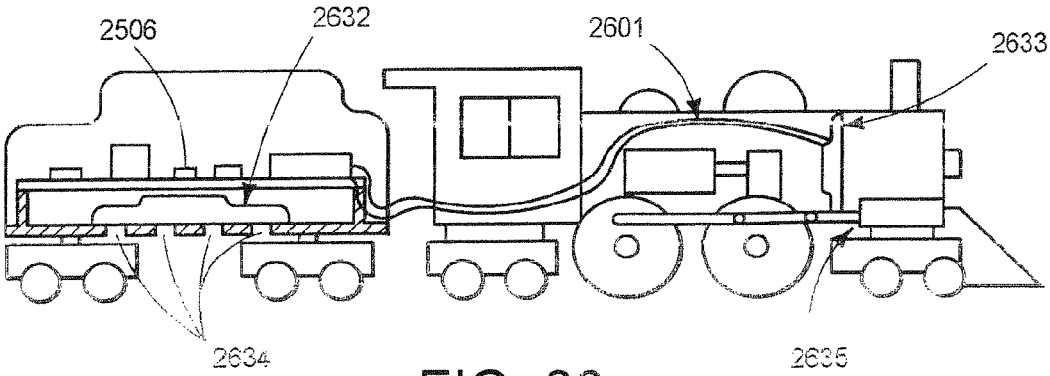
FIG.. 26

FIGURE 32A
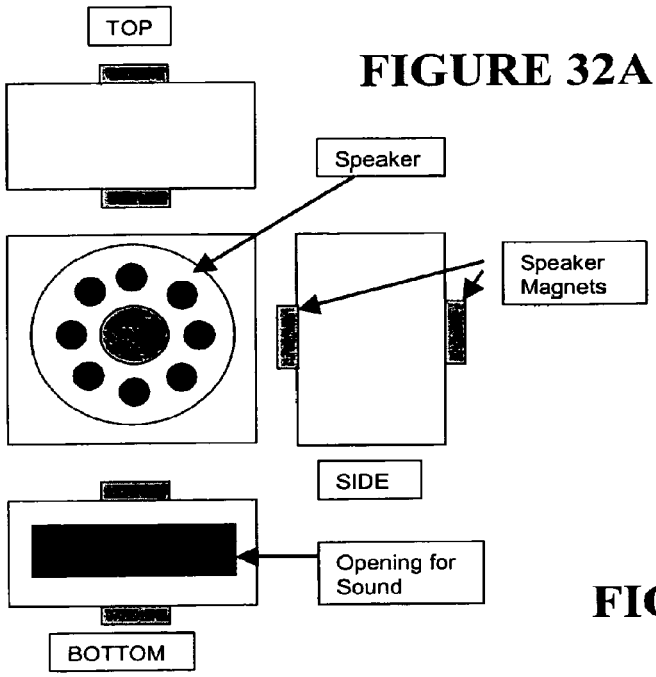
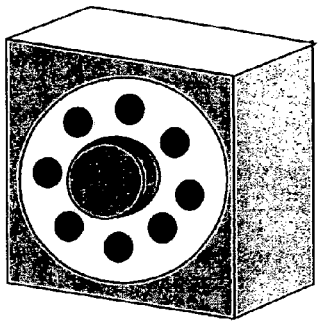
FIGURE 32B
FIGURE 32C
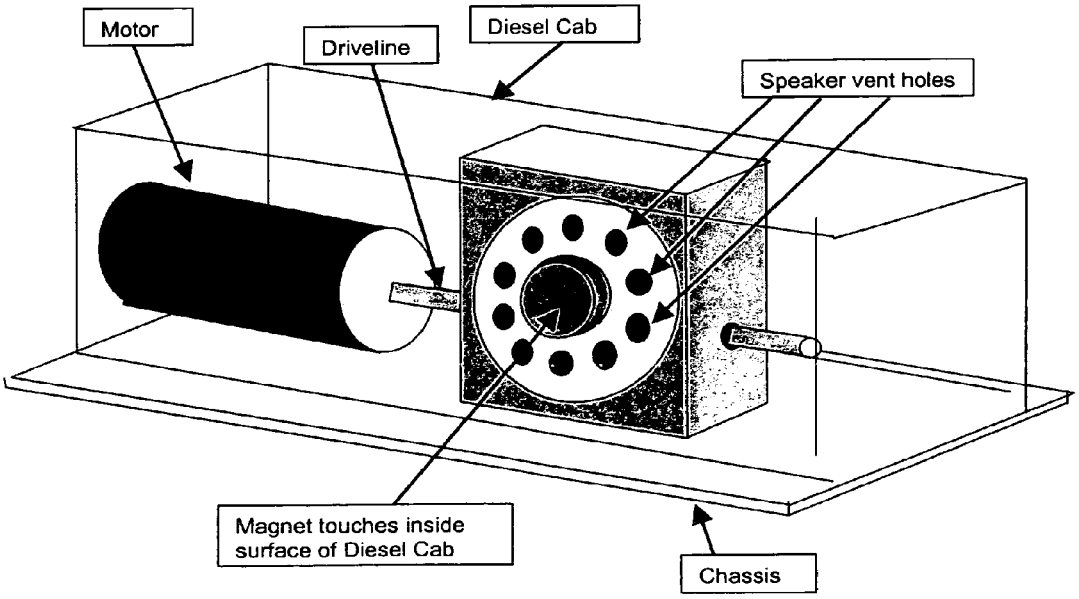

SIGNALING AND REMOTE CONTROL TRAIN OPERATION

RELATED APPLICATIONS

This application is a divisional application and claims priority from pending U.S. application Ser. No. 13/455,417 filed Apr. 25, 2012, which is a divisional of U.S. application Ser. No. 13/152,657 filed Jun. 3, 2011 now U.S. Pat. No. 8,166,887, which is a divisional application and claims priority from U.S. application Ser. No. 12/176,275 filed on Jul. 18, 2008 now U.S. Pat. No. 7,954,435, which is a divisional application and claims priority from Ser. No. 11/075,469 filed Mar. 8, 2005 now U.S. Pat. No. 7,451,708, which is a non-provisional application and claims priority from U.S. Provisional Application No. 60/551,652 filed Mar. 8, 2004, all of the aforementioned applications are herein incorporated by reference.

COPYRIGHT NOTICE

© 2004-2005 QSIndustries, Inc. A portion of the disclosure of this patent document, including but not limited to the drawings, contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR §1.71(d).

TECHNICAL FIELD

This invention pertains to on-board generation of sound effects in motorized toys, and particularly in diesel, electric, and steam locomotives and other model types.

BACKGROUND OF THE INVENTION

On-board sound became very popular in 1994 when QSI introduced a high-quality, low-cost sound system for three-rail O'Gauge locomotives and when the Lionel Corporation introduced a competitive digital system about the same time. In only about three years, sound was offered in almost all top-of-the-line three-rail O'Gauge locomotives and was starting to appear in the low-end model three-rail locomotives as well.

The advent of inexpensive on-board digital sound for three-rail O'Gauge trains only became possible and popular when small affordable digital microprocessors became available that would allow sufficient sound processing within the limited space of model train locomotives. Sufficient space within the locomotive was not only needed for the electronics but was also required for acoustic sound quality and speaker placement. As the three-rail O'Gauge manufacturers began to install sound in smaller O'Gauge engines, they were forced to use smaller speakers, which often sacrificed sound quality.

A typical sound installation is shown in FIG. 1 for an O'Gauge three-rail diesel in this partial cut-away view of cab and chassis. Most three-rail O'Gauge engines have two vertically mounted DC "Can" permanent magnet motors 100 and 101 mounted directly over the diesel trucks 102 and 103 with worm and worm gears to drive one of the metal axles directly in each truck. The other axles in the trucks are linked to the driven axle with spur gears so all or most of the locomotive's wheels have power. Flywheels, 104 and 105, are often added to the motor shafts to provide coasting action should power be lost. It is also believed by most customers that the flywheel improves low speed performance. The motors are powered and controlled by the Sound and Motor Drive Electronics 106.

The chassis, motors and electronics are enclosed by the diesel body, 109 (also called a diesel cab). There are three popular diesel cab styles, wide-bodied cabs, 1700, as shown in FIG. 17, narrow-bodied cabs with high hoods, 1800, as shown in FIG. 18 and narrow-bodied cabs with low hoods, 2700 as show in FIG. 27. All three diesel types have about the same chassis width as measured at the engineers cab area, 1701, 1801, and 2701 even though the hood or body width, W-1, W-2, W-3, varies. The narrow-bodied types of engines have outside walkways along the sides of the hooded area that make up the extra width. The wide-bodied diesels have the advantage of more interior space for electronics, speakers, and motors. The narrow-bodies, however, are more popular and account for larger variety and larger number of prototypes and models manufactured and sold.

Model diesel cabs are usually made of injection molded plastic although brass cabs are also popular albeit expensive and a few die-cast cabs have been produced as well. The diesel cabs may also have openings that can affect the sound quality such as the fans, 1703 and 1803, and ventilation vents or grills, 2702, 2703 and 1702, 1802, and their counterparts on the other side of the body, 1704 and 1804, not visible in the views shown in FIGS. 17 and 18. Other possible openings are the windows, portholes on the side, smoke stacks, etc. Engine models, like electric locomotives (GG-1, EP-5, E-33, etc.) have similar drive methods and sound issues as diesels. Cabs for electric locomotives also include wide body and narrow body types.

The vertical motor layout shown allows sufficient room between the motors 100 and 101 to mount a full-featured sound and motor control electronics board, 106. A single speaker 107, is usually mounted facing down or facing up in the fuel tank area below the chassis 156. It is either sealed face up to a vent hole in the chassis, 110, or mounted face down and sealed to the bottom of the fuel tank, 108, and covering venting holes 111. In either case, the speaker's front wave and back wave are separated. When mounted facing up, the front wave is vented into the sealed diesel cab area and the back wave is vented to the outside through the holes in the bottom of the fuel tank. When mounted facing down in the fuel tank, the front wave exits through the series of holes, 111, and the back wave enters the sealed diesel cab area through vent hole 110. The diesel cab area or "interior volume" defined by the chassis, 156, and diesel body 109 acts as a resonate cavity and improves both the base response and the audio volume. There appears to be little difference in sound quality between mounting face-up or face-down. However, for narrow-bodied diesels, the vent hole, 110, must have a diameter less then or equal to the interior width of the diesel cab which will partially block the speaker's front wave if the speaker is mounted face-up. Since the fuel tanks have about the same width, a full width speaker can be mounted face-down in most diesel types.

To avoid confusion between what we mean by back wave and front wave, we will restrict our examples to the method where the speaker is mounted face-down with front wave exiting to the outside through the holes, 111 and back wave entering the cab area through hole 110.

One advantage of using vertical motors mounted directly over the trucks is that it provides an unencumbered interior space above the fuel tank to allow sound to enter the cab area and sufficient room to mount the sound circuit board, 106, to the chassis surface, and to allow heat sinking the circuit board to the metal chassis as required. The circuit board width and mounting are generally designed to allow sound to pass around the circuit board and/or around the mounting studs, 175, to utilize as much of the diesel cab volume as possible.

Sound Installation in Smaller Gauge Engines:

It becomes more difficult to use the same motor and flywheel design for smaller gauge engines like HO and N scale, which, in turn, requires different designs for sound systems, acoustics and speaker installation. There is little difficulty in achieving high quality acoustic sound design for most steam engines since the sound can be installed in the tender in the same way it is done for O gauge steam locomotives as shown in FIG. 25. (In FIG. 25, speakers, 2531 are mounted in the tender, vented out the chassis vent holes 2532. An audio electronics/motor control circuit board 2506 connects to a motor 2500 in the locomotive 2501 which, in turn, drives gear tower 2512 to drive the wheels.) However, installation in HO diesels and electrics, and in particularly, in narrow body, low hood types is problematic. This can be better understood by examining how most HO drive systems operate.

The most common type of motor and drive train for HO and N type engines is shown in FIG. 2. Instead of two vertical motors, each with flywheels, only one horizontal motor, 200, is used with two flywheels, 204 and 205, mounted on the front and rear motor shafts. Power is transmitted through drive shafts, 216 and 217, through telescoping universal joints 214 and 215, to gear-towers 212 and 213, that in turn power the trucks 202 and 203, respectively. The telescoping universal joints 214 and 215 allow the trucks sufficient rotation and vertical motion to navigate through curved and uneven track. The drive shafts, 216 and 217, are connected to the metal flywheels at mounting assembly points 219 and 220 to ensure that the drive shafts are locked to rotate with the flywheels.

The motor, 200, is usually mounted directly to the chassis 256. In many designs, the motor is mounted low into the fuel tank area, 208, to provide a lower profile, lower center of gravity and more headroom for circuit board, 206. The fuel tank area is often filled in with metal to increase the engine weight with a decorative outer plastic shell to provide model detail. By definition for this patent, the term "drive-train", as distinct from the motor and trucks, constitutes the components of motor shaft, and driveline, and depending on the design may include one or more of flywheel(s), universal joint(s), gear-tower(s), gear tower(s) driveline support(s), pulley(s) and belt(s). In other words, the drive-train generally can be said to connect the motor to the truck(s).

Because the fuel tank is usually solid and because the motor sits directly over the fuel tank, there is little or no room in the tank area to mount speakers or to vent the back wave into the cab interior volume, to improve the sound quality. In addition, the fuel tank is close to the track in HO and N scale locomotives, which will cause too much sound energy to reflect back and degrade the sound quality and volume. To mitigate these problems, speakers are often mounted on the inside of the cab, directly interior of decorative grills or fan openings, such as 1703, 1702 in FIG. 17 and 1802 and 1803 in FIG. 18, and 2703 and 2702 in FIG. 27, to vent the sound directly to the outside. Vent and fans are often limited in surface area, however, or are shaped in a way that does not allow the maximum speaker area possible to vent sound to the outside and the resultant sound quality and volume are poor. It is desirable to use the largest speakers possible, which is not always consistent with the available grill and vent area for particular locomotive models.

In addition, because the motor is not directly mounted over the trucks, there is usually more opportunity for the back wave to escape through large openings needed for the gear tower or other truck drive mechanisms to rotate as the truck turns to negotiate through curved track. These gear tower holes are shown by open areas 221 and 222 in FIG. 2 and in FIG. 4, which shows a top view of the chassis with cab removed. Any sound escaping through these holes can easily be propagated to the outside through the open truck assemblies, 202 and 203. Mixing of back wave and front wave from these open areas, 221 and 222, over the trucks further degrades the sound quality.

Another restriction in the acoustic design is the space consumed from added metal weights. These weights are used to increase the overall tractive force of the engine and are sometimes used to hold or support lamps, lighting boards, electronic circuit boards (such as DCC decoders), etc. within the engine's interior. Any acoustic design must not compromise the pulling power or other features of the locomotive too severely or it will decrease the desirability of the engine.

SUMMARY OF THE INVENTION

Sound System Guidelines: Some of the principle aspects of the present invention are the following:

1. Separate Back Wave from Front Wave:

It is important for sound quality that the interior cab volume be sealed as much as possible to prevent the back wave from escaping, for example through grill or fan openings or other openings in the diesel cab, or through the openings in the chassis where the motors connect to the trucks. To the extent there is leakage of the back wave to the outside, it will mix with the speaker front wave and cause destructive interference for some base tones and potentially constructive interference for some of the higher frequency tones. The respective path lengths for the front wave and the escaping back wave and the position of the listener will determine which frequency components are degraded or changed. Usually, since the acoustic chamber and path lengths are short, any back wave escape causes degradation of the sound quality. If the back wave is allowed to escape close to the front wave, the degradation is more severe. As the scale of the model decreases, this becomes more of a problem since the distances between front and back waves becomes smaller.

2. Engine Cab and Chassis Materials Affect Sound Quality:

In addition to above concerns, the back wave can also effectively escape by exciting or vibrating the locomotive cab, which, in turn, re-radiates the sound. This can help or degrade the sound quality, depending on the cab material. Die cast cabs generally will re-radiate very little sound and produce excellent sound quality although the maximum sound volume is usually reduced. Plastic cabs are the most transparent to sound and produce tinny sounds but with higher volume. Brass cabs produce the best quality and at high volume levels. However, because there are so many unknown or uncontrolled variables in the acoustic modeling for re-radiating cabs, it is difficult to determine an optimal sound design that applies to all engine types.

3. Use the Biggest Speaker Possible:

No matter how clever we have been in our acoustic design using small speakers, the best sound always comes from using the biggest speaker possible. The biggest practical speaker usually has a diameter about the same as the width of the engine chassis. We call this a "full width speaker".

4. Use the Biggest Resonant Cavity Possible:

The volume for the sealed back wave can have a big affect on the sound system base response. Whenever possible, always maximize the cavity volume.

5. Vent the Sound Under the Engine:

Propagating sound upward into the open air seems to produce lower quality sound unless the listener is directly over the speaker. The sound has no opportunity to reflect against different parts of the layout such as buildings, mountains, etc. that add both volume and presence. Our experience is that a preferred design choice is to propagate the sound under the locomotive or out the sides of the locomotive through vents and grills. If sound is vented under the locomotive, one should be mindful of the affect of trucks and other obstacles and other factors that can either improve or degrade sound quality. Do not vent sound straight down too close to the track where it can be reflected back and decrease volume and sound quality.

6. Impedance Matching:

One other design concern is impedance matching of the sound produced by the speaker or speakers to the outside. Although there is seldom enough room to make this the highest priority, due consideration should be given to impedance matching whenever there is an opportunity to do so.

To further describe and illustrate the invention, on-board model railroad speaker enclosure designs are presented that allow maximum sized speakers, improve impedance matching of sound to the outside of the locomotive, separate back and front speaker waves while maintaining the standard horizontal drive-train in model train locomotives. Illustrative embodiments are presented for diesels or electric locomotives: one for wide bodied diesels where the speakers lie flat within the locomotive, another for narrow bodied, high hood diesels using an A-frame enclosure and a third for narrow bodies diesels with low hoods, using a slanted or lean-to type of enclosure. A fourth speaker placement design is also included that uses a large flat speaker but requires a change in the standard drive train. Two additional speaker placement designs show installation in steam locomotives and steam locomotive tenders. The various embodiments disclosed herein are provided by way of explanation and not limitation.

Additional aspects and advantages of this invention will be apparent from the following detailed description of preferred embodiments, which proceeds with reference to the accompanying drawings.

BRIEF DESCRIPTION OF THE DRAWINGS

FIG. 24 shows a lean-to arrangement for narrow-bodied engines with a high hood where a full width speaker sits diagonally across the available cross section of the engine body with enclosure underneath.

FIG. 25 (prior art) shows cross section of steam engine and tender model where full width speakers are mounted flat down on tender chassis and where sound is vented through vent holes to the area under the tender.

FIG. 26 shows a mid-range speaker mounted in engine boiler and larger bass speaker mounted in tender.

FIGS. 32A-32C illustrate an alternative embodiment of the A-Frame structure with vertically mounted speaker or speakers, called a Cube Enclosure.

DETAILED DESCRIPTION OF PREFERRED EMBODIMENTS

Figure 1:
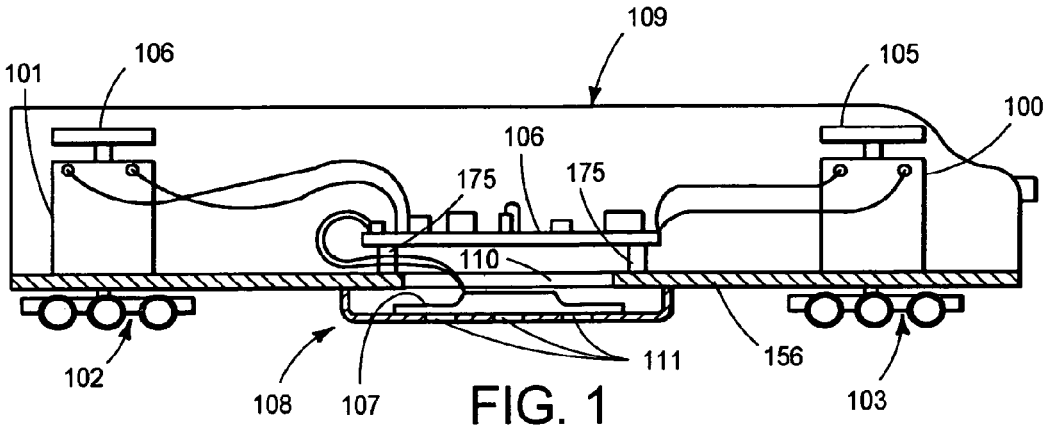
FIG. 1 Prior Art
FIG. 1 (prior art) shows the interior of a typical three-rail O'Gauge sound equipped locomotive using vertical motors with top mounted flywheels, electronic circuit board mounted on studs and speaker mounted in fuel tank area.
Figure 2:
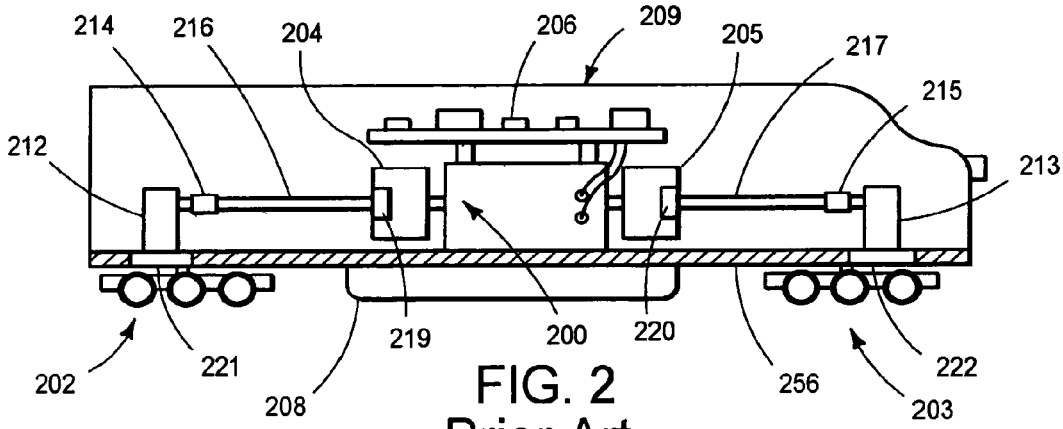
FIG. 2 Prior Art
FIG. 2 (prior art) shows the interior of a typical two-rail non-sound equipped engine with a single horizontal motor with two flywheels, drivelines, and universal couplings connected to gear towers at both ends of locomotive.
Figure 3:
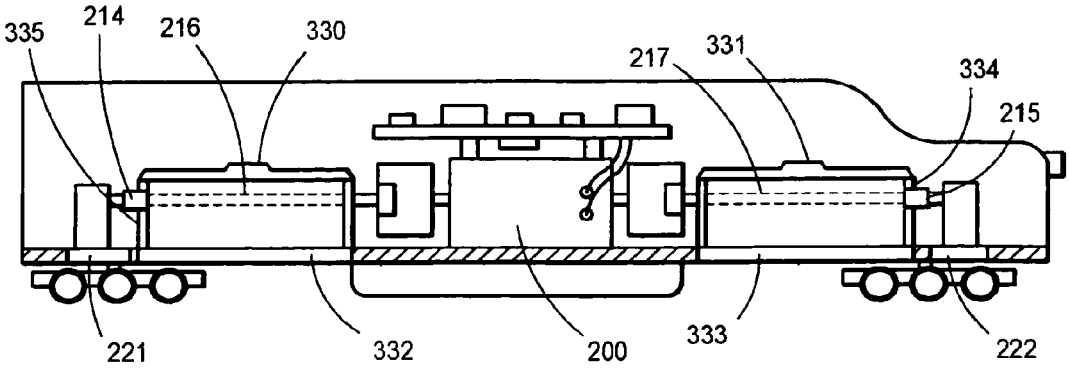
FIG. 3 illustrates one embodiment for implementing sound in an engine with horizontal drive trains by placing speakers flat over speaker enclosures located over holes in the chassis floor.
Figure 4:
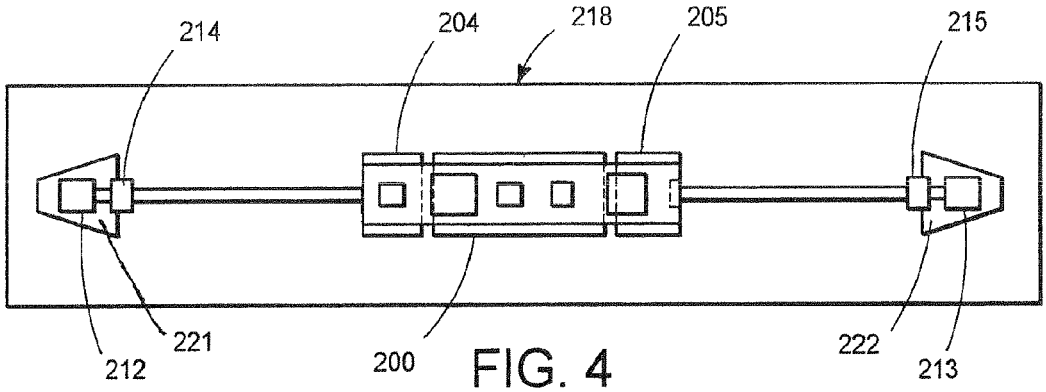
FIG. 4 Prior Art
FIG. 4 (prior art) is a top view of the locomotives interior in FIG. 2 showing the drive train and openings at each end to accommodate the gear tower rotational movement.
Figure 5:
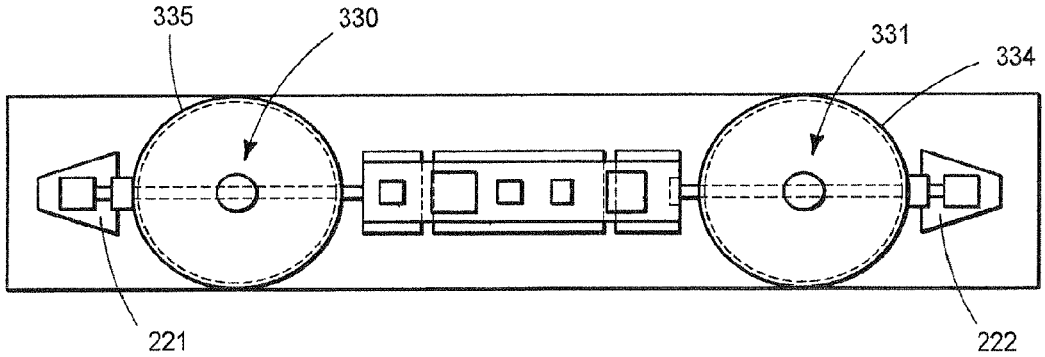
FIG. 5 is a top view of the locomotive's interior in FIG. 3, showing how the speakers can be located in a wide-bodied diesel or electric type locomotive model.

Wide-Bodied Diesels:

FIG. 3 shows one method to overcome these difficulties for wide-bodied diesels. Speakers for wide bodied diesels can have a diameter equal to the inside width dimension of the diesel cab. The speakers 330 and 331 are each supported by a generally hollow speaker mounting enclosure or "speaker tube" 334 and 335. The chassis has additional openings, 332 and 333, to allow the front wave from the speaker to propagate under the locomotive and pass to the outside through the open trucks and other open areas under the engine. These openings to vent the speaker front wave through the chassis can be configured as one large opening, as shown, or as a plurality of smaller openings as convenient. The drivelines, 216 and 217 and the universal joints, 214 and 215, pass through custom holes at the front and back of the speaker tubes. These driveline holes are only large enough to allow the drivelines or other components of the drive-train to pass through and operate without mechanical interference. This minimizes the front wave from the speaker mixing with the back wave and causing destructive interference of the sound. FIG. 5 shows a top view of the chassis with the speakers, 330 and 331, shown mounted to the speaker tubes 335 and 334 respectively.

Figure 6:
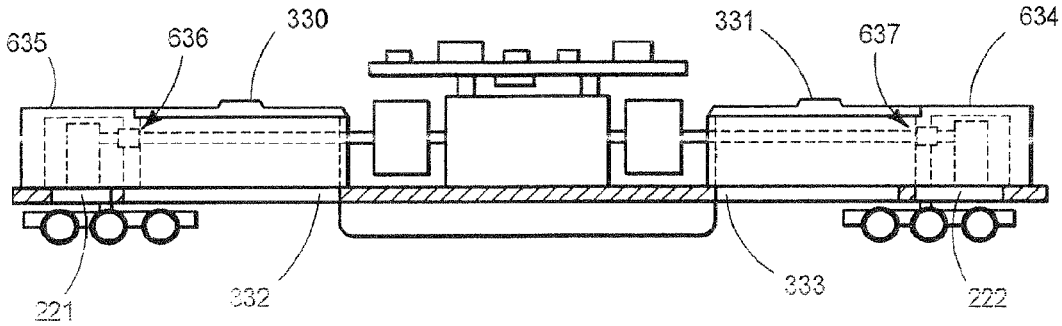
FIG. 6 shows how the enclosure in FIG. 3 can be extended to cover the gear tower holes to improve the sound quality by minimizing back and front speaker wave mixing.
Figure 7:
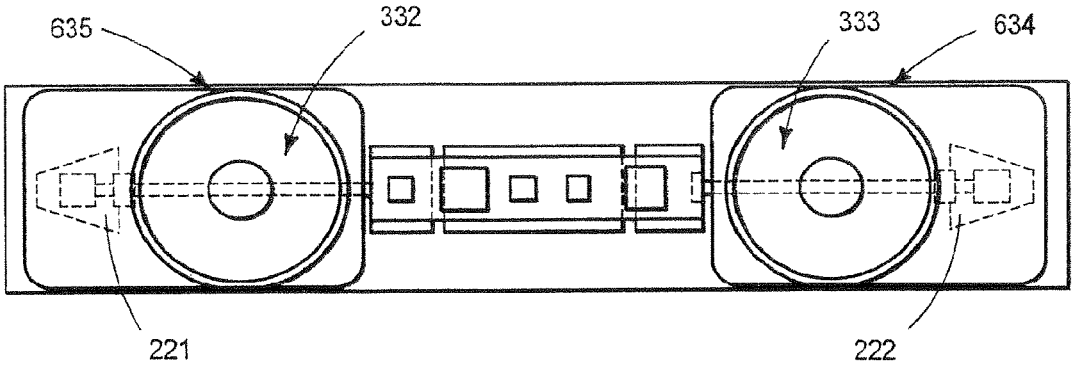
FIG. 7 is a top view of FIG. 6 showing the extended speaker enclosure that covers the gear tower area.
Figure 11:
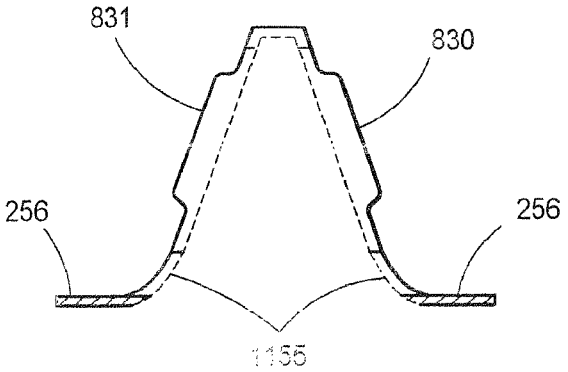
FIG. 11 is an end view of an A-frame design showing how impedance matching can be improved by flaring the ends of the A-frame interior where it connects to the chassis openings under the locomotive.
Figure 19:
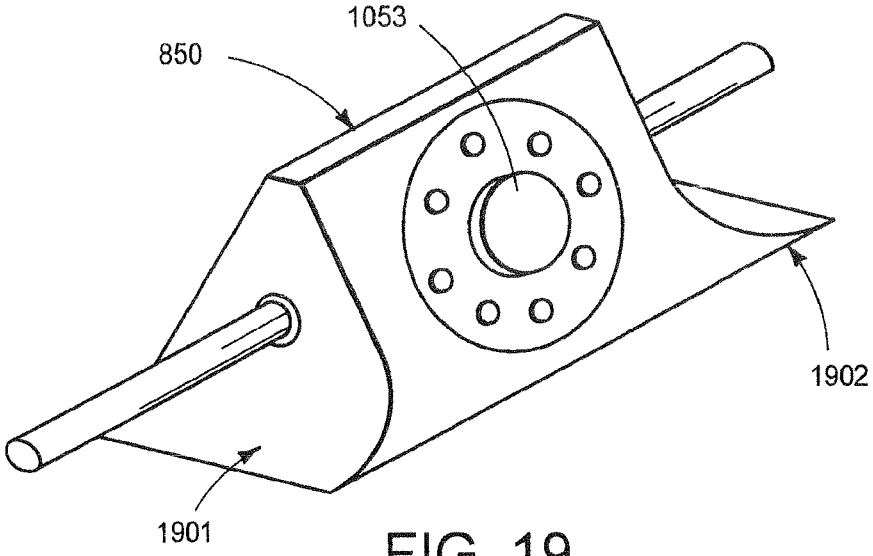
FIG. 19 shows an A-frame speaker enclosure where the base has been flared out in all directions to improve impedance matching to the outside.

One problem with this design is that the back wave and front wave speaker sounds can still mix through gear tower holes, 221 and 222. These holes can be covered and sealed as shown in FIG. 6, where enclosures 634 and 635 cover the gear tower holes, 221 and 222. The speaker tube enclosure is maintained by the interior walls 636 and 637, which directs the sound to speaker openings 332 and 333. If space allows, the speaker tubes can also be designed with flared ends to provide an open horn structure or exponential curve to improve impedance matching of the sound to the outside. Examples of flared transitions are shown in FIGS. 11 and 19. FIG. 7 shows a top view where enclosures 635 and 634 cover the chassis speaker tube holes 332 and 333 as well as gear tower holes 221 and 222. The enclosures also provide additional weight to compensate for openings in the chassis and provide additional traction. If there is headroom available over the motor and flywheels, the two separate enclosures can be extended to cover the motor flywheel area to provide a single enclosure over the entire chassis. This allows additional freedom to design the shape of the speaker resonator tubes to provide better impedance matching to the outside.

In relatively short, wide bodied locomotives where there is not enough room to mount the speakers between the flywheels and the gear tower, the speakers can often be mounted directly over the gear towers. In this case, the speaker tubes each enclose a gear tower and isolate the open area in the chassis where the gear tower passes though the chassis to the trucks. This method, like the method described above, will separate and isolate the speaker back wave from the front wave.

This method for short wide bodied locomotives may require a lower gear tower design to allow the speaker cone to move up and down without interference from the top of the gear tower. Also, because the speaker tube is filled with more of the drive train components, there will be more interference to the sound passing to the outside of the locomotive.

Narrow-Bodied Diesels:

Narrow bodied diesels provide an additional problem. Although the chassis width stays the same, the diesel cab hood region is only about half as wide over most of the length of the locomotive. The drive mechanism consisting of motor and drive train remains essentially the same. The narrower body and drive mechanism prevents mounting speakers flat that span the width of the chassis. Smaller speakers with a diameter that can fit from side to side inside the narrower body are usually too small to produce good volume and sound quality.

Figure 8:
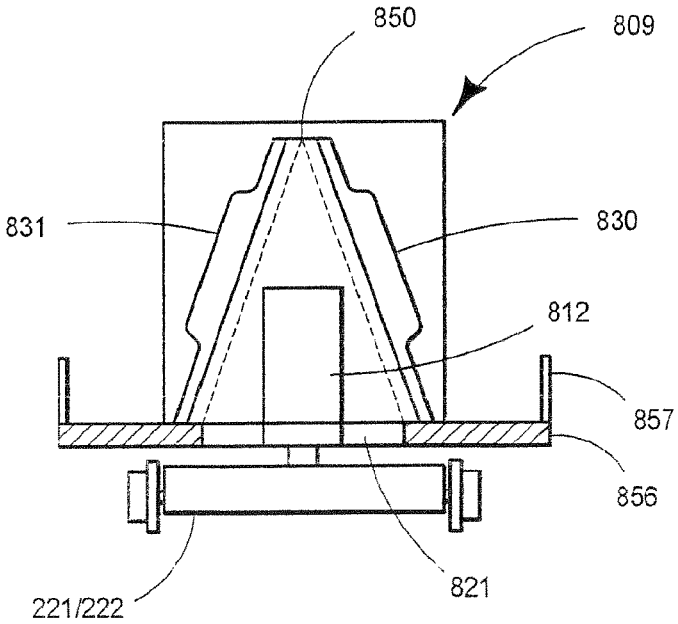
FIG. 8 shows an end cross-sectional view of an A-frame speaker enclosure that allows large speakers to be used in narrow-bodied diesels and still maintain the common horizontal drive train.

Instead of laying the speakers flat as in the previous examples, we propose mounting the speakers at an angle. FIG. 8 shows the end view of a narrow bodied model locomotive where two large speakers are placed in an A-frame structure, 850, over a hole in the chassis 821 to allow the speaker front waves to pass to the bottom of the locomotive out through openings in the diesel truck and other open areas under the engine. The diesel cab detail is not shown except for its outline, 809. This novel method of mounting the speakers over the drivelines and/or universal joint or other drive train components, allows large speakers to be mounted in narrow bodied engines without altering the essential horizontal-motor and drive-train design that is so common in O, HO and N scale model diesel locomotives.

Figure 9:
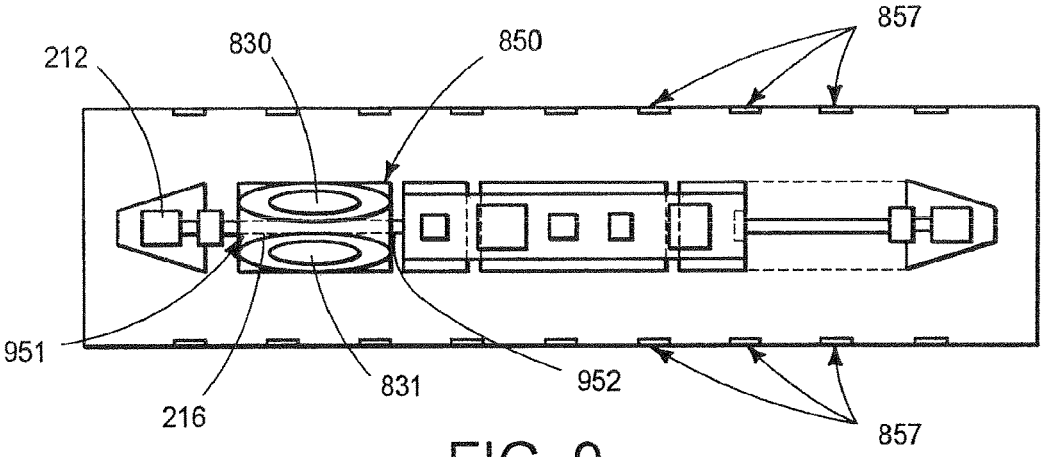
FIG. 9 is a top view of the locomotive of FIG. 8 indicating how the A-frame straddles parts of the drive train.
Figure 23:
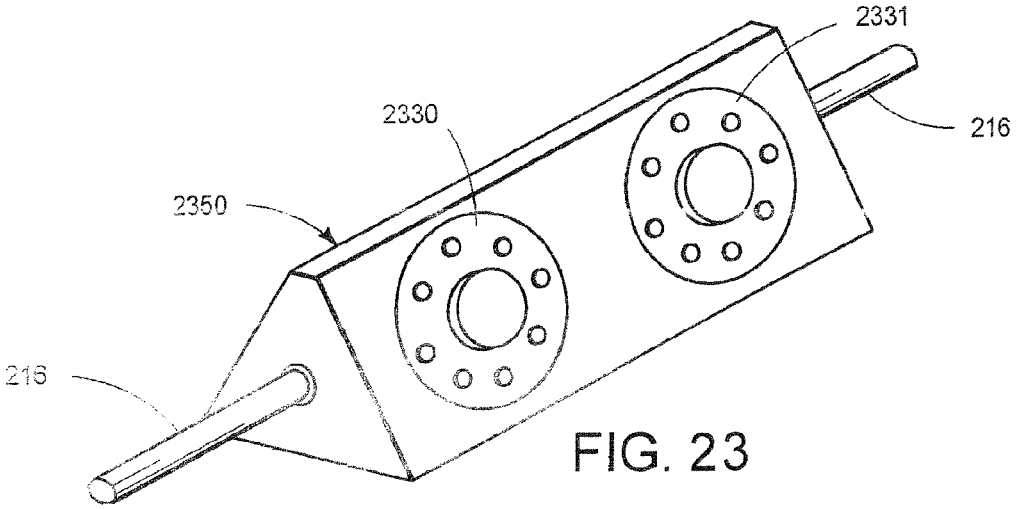
FIG. 23 shows an extended A-frame to allow additional speakers for improved acoustics.
Figure 27:
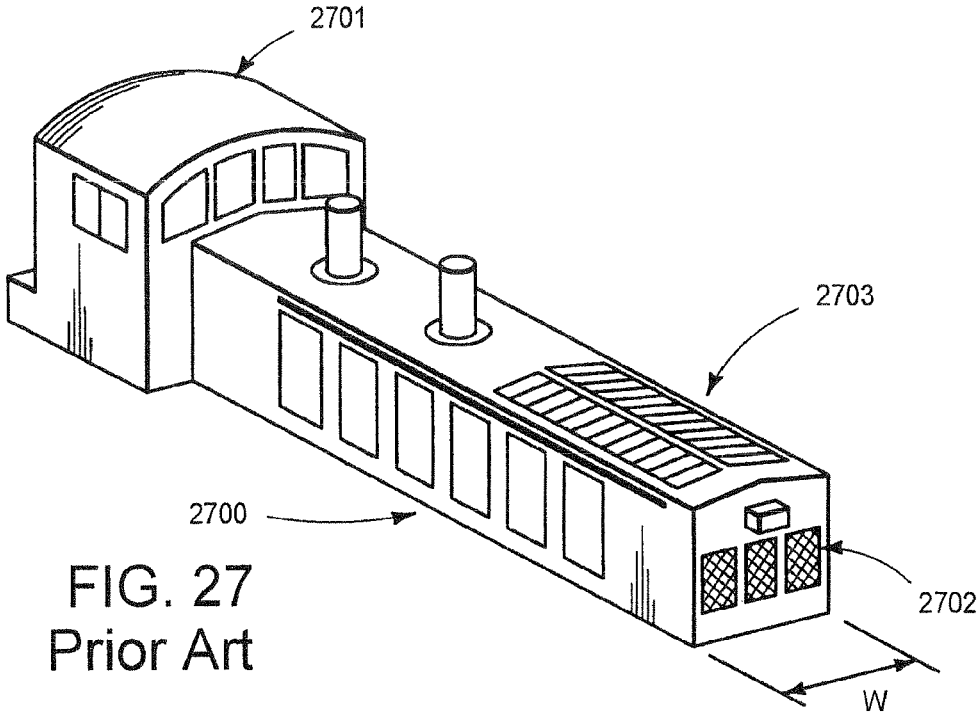
FIG. 27 Prior Art
FIG. 27 (prior art) is the body of an NW-1 diesel switcher, which is a good example of a narrow body, low hood body type.

FIG. 9 shows a top view of the chassis in FIG. 8. Here the angled speakers, 830 and 831, look oval shaped setting in the A-frame structure, 850. In order to prevent the back wave from mixing with the front wave and to provide better impedance matching to the A-frame chassis hole, both the front and rear ends of the A-frame structure should be sealed off as much as possible. In this case, where the A-frame only spans the driveline, small holes, 951 and 952, can be added to the ends of the sealed A-frame structure to allow the driveline, 216, and/or other parts of the drive-train to pass through with minimum mixing of front and back speaker waves. If there is room and it is desirable to have a longer A-frame for acoustic reasons, the A-frame can be extended. An extended A-frame can also allow additional speakers as shown in FIG. 23 where four speakers are indicated.

Figure 10:
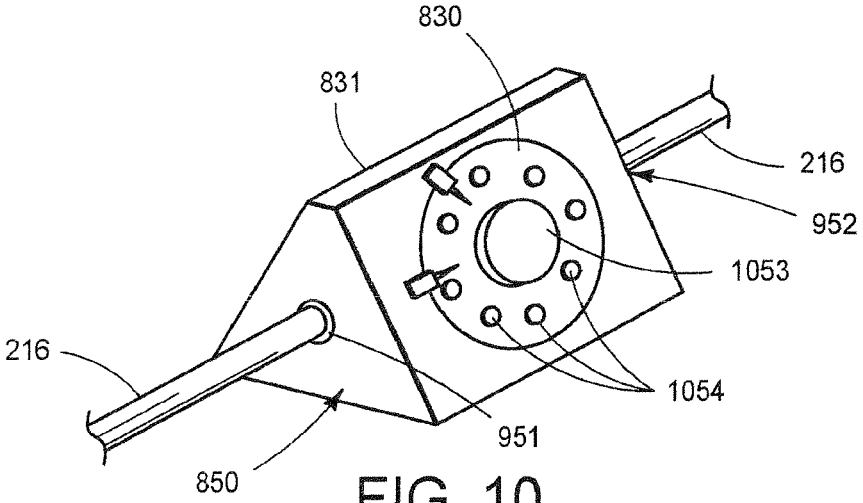
FIG. 10 shows a detail of one type of A-frame speaker enclosure with drive line passing through the A-frame interior under the speakers.

FIG. 10 shows the detail of the A-frame structure, 850. Both ends of the A-frame structure have small holes, 951 and 952 to allow driveline, 216, to pass through. The holes 951 and 952 are just large enough to allow unencumbered movement of the driveline and/or related drive train parts, including lateral motion due to the rotation of the gear tower, 212, (see FIG. 9) and any vertical motion generated by the diesel truck moving up and down during travel. The speaker 830 is shown on one face while the other speaker, 831, cannot be seen from this view. Speaker 830 is shown facing in towards the interior of the A-frame with speaker magnet, 1053 and back-wave speaker vent holes 1054 facing out. The second speaker, 831, is also facing towards the interior of the A-frame structure. When operating, speakers will be phased to both move inwards to the A-frame interior or outwards from the A frame interior in response to the same applied speaker forcing function. The A-frame design could be used with only one speaker but the amount of acoustic energy would be reduced.

The A-frame structure also improves impedance coupling to the outside through a tapered tube that opens up at the bottom. The interior of this enclosure can also be designed to have a shape that is optimized for impedance matching such as a exponential curve. FIG. 11, shows interior surface of the speaker enclosure with speakers 831 and 830 and with curved or exponential shaped surfaces, 1155, and continuing through the chassis 256 to improve impedance matching. Both the ends and sides of the enclosure, 850, can be tapered with a curved surfaces, 1901 and 1902, as shown in FIG. 19. The interior surface is also tapered out in the same proportion whose curves continue through the chassis opening under the enclosure.

FIGS. 32A-32C show an A-Frame structure where the speakers are mounted vertically instead of at a slant (as shown in FIG. 10 and FIG. 11). We call this alternative embodiment of the A-frame enclosure a "Cube" enclosure. FIG. 32A shows front, side, top and bottom view of the Cube. The bottom view shows an opening for front wave sound to propagate out of the Cube interior. FIG. 32A shows a Cube with two speakers, mounted on opposite sides. If only one speaker is used, the opening on the other side is sealed to prevent front wave sound from escaping. FIG. 32B shows a perspective drawing of the Cube enclosure. FIG. 32C shows how the Cube is utilized in much the same manner as an A-Frame in the model locomotive, with the driveline or other drive train components passing through the interior of the Cube as necessary. This structure is preferred if the speaker magnets or speaker thickness is too large or the drivetrain components are too large to fit in the more restricted area of the slanted speaker structure in FIG. 10. Just like a slanted A-Frame structure, the Cube can be designed to allow the front wave to propagate out through the bottom opening to the exterior of the locomotive. The backwave will propagate out speaker vent holes to the interior of the locomotive where this back wave sound will be contained or at least controlled to minimize it from mixing with the front wave sound.

Figure 28:
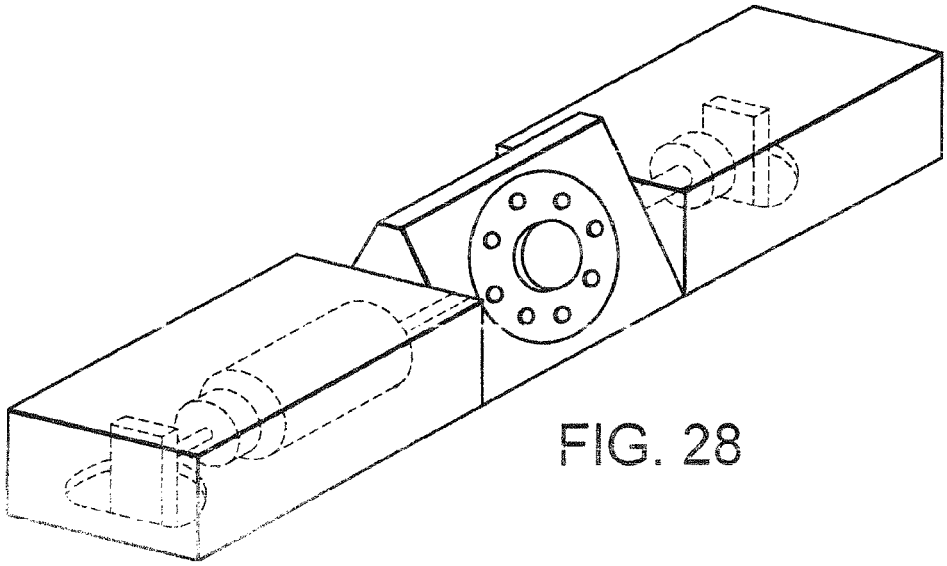
FIG. 28 shows an extended enclosure to cover all parts of the drive train, motor and openings in the chassis to provide a completely sealed chamber inside the engine body for the front wave to minimize mixing of back wave and front wave.

To prevent problems with the front wave escaping through the holes at the ends of the A-frame needed for drive train components, the speaker enclosure could be extended to cover all parts of the drive train, motor and openings in the chassis as shown in FIG. 28. In this embodiment, the drive train components and motor are shown outlined in dotted lines. This enclosure would provide a substantially sealed chamber inside the engine body for the front wave to prevent any mixing of back wave and front wave. Here, the "wings" shown in FIG. 12 have been removed.

FIG. 24 shows another arrangement for narrow-bodied engines with a high hood. Here fitting the speaker diagonally across the available cross section of the diesel cab and supporting it with a speaker enclosure that is like one-half an A-frame achieves extra room for large diameter speakers. This lean-to speaker enclosure can also provide more room for a larger speaker magnet, 2453, to provide better sound quality. Just like the A-frame structure, components of the drive train will run through the lean-to enclosure under the speaker.

Figure 20:
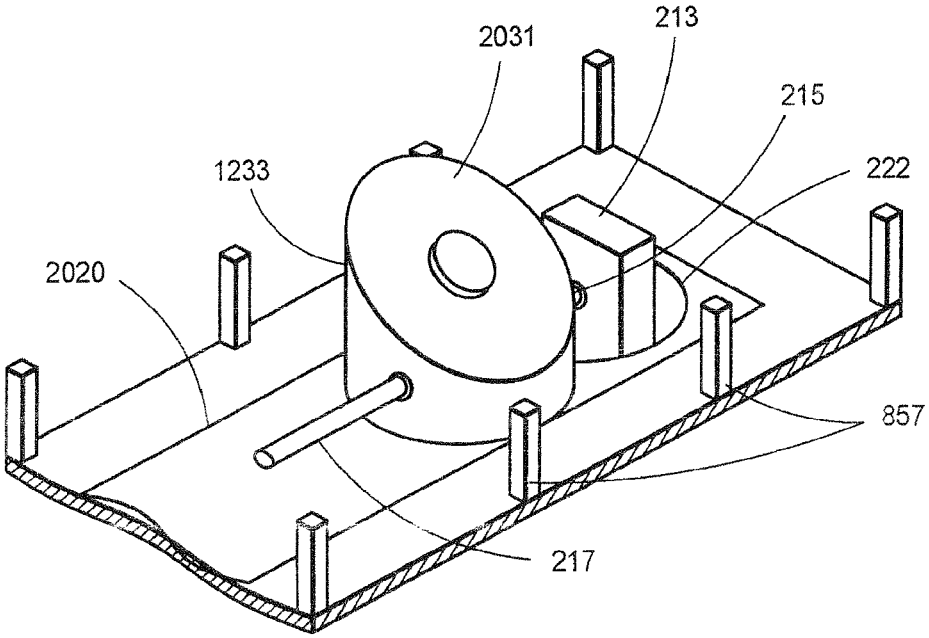
FIG. 20 shows a speaker larger than the interior width of a narrow body diesel mounted on an elliptical speaker tube open at the bottom where the drive line passes through the tube.
Figure 21:
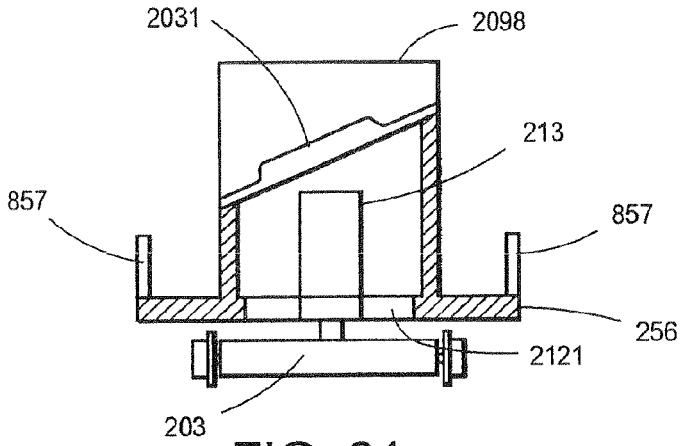
FIG. 21 shows the cross section of a narrow body diesel with speaker mounted at a tilt on the speaker tube with chassis hole that allows sound to emanate over the truck area under the locomotive.

If the engine has a low body, it may not be suitable for a lean-to enclosure that uses the full cross sectional hood area for a speaker since there could be interference with some of the drive train components. In this case the speaker can be mounted at a lesser slant and elevated. FIG. 20 shows the end section of a narrow-bodied diesel with a low hood. Here the speaker, 2031, is too large to fit flat in the width of the locomotive but will fit if mounted at a slant on top of tubular speaker enclosure 1233. FIG. 21 shows an end view of the same locomotive, showing the speaker, 2031, mounted at a slant. The speaker enclosure is designed to be high enough on the low end to clear the gear tower and high enough at the high end to allow the largest possible speaker. A hole in the chassis, 2121, is provided to allow the sound to exit under the locomotive as shown in the partial cut-away end-view of the cab and chassis.

Figure 22:
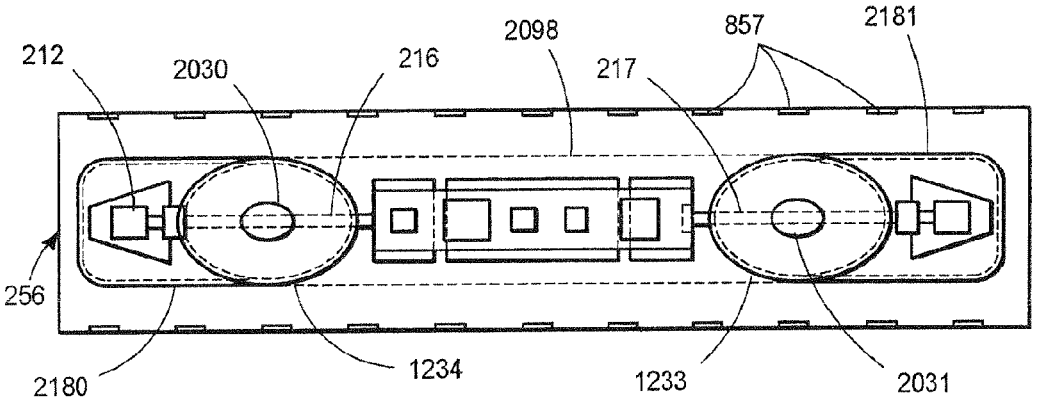
FIG. 22 shows a top view of the entire narrow body locomotive with two speakers, mounted at a slant with speaker enclosure extensions that cover the gear tower areas.

In FIG. 20, the driveline, 217, is the drive train component that runs through the enclosure but it could be other components as well such as universal joint, 215, or gear tower, 213. Like the wide-bodied locomotive, the enclosure can be placed or extended over the gear tower to prevent the back wave from escaping through the gear tower hole, 222 and mixing with the front wave. FIG. 22 shows a top view of the entire locomotive with two speakers, 2031 and 2030 mounted at a slant as indicated by their elliptical shape in the drawing and speaker enclosure extensions 2180 and 2181. To balance the sound, one speaker might be slanted high on the left side while the other speaker is slanted high of the right side of the engine although this will probably not make much difference. If there is room and it is desirable to have a longer lean-to for acoustic reasons, the lean-to can be extended. An extended lean-to can also allow additional speakers in the same manner as the extended A-frame that is shown in FIG. 23.

Figure 12:
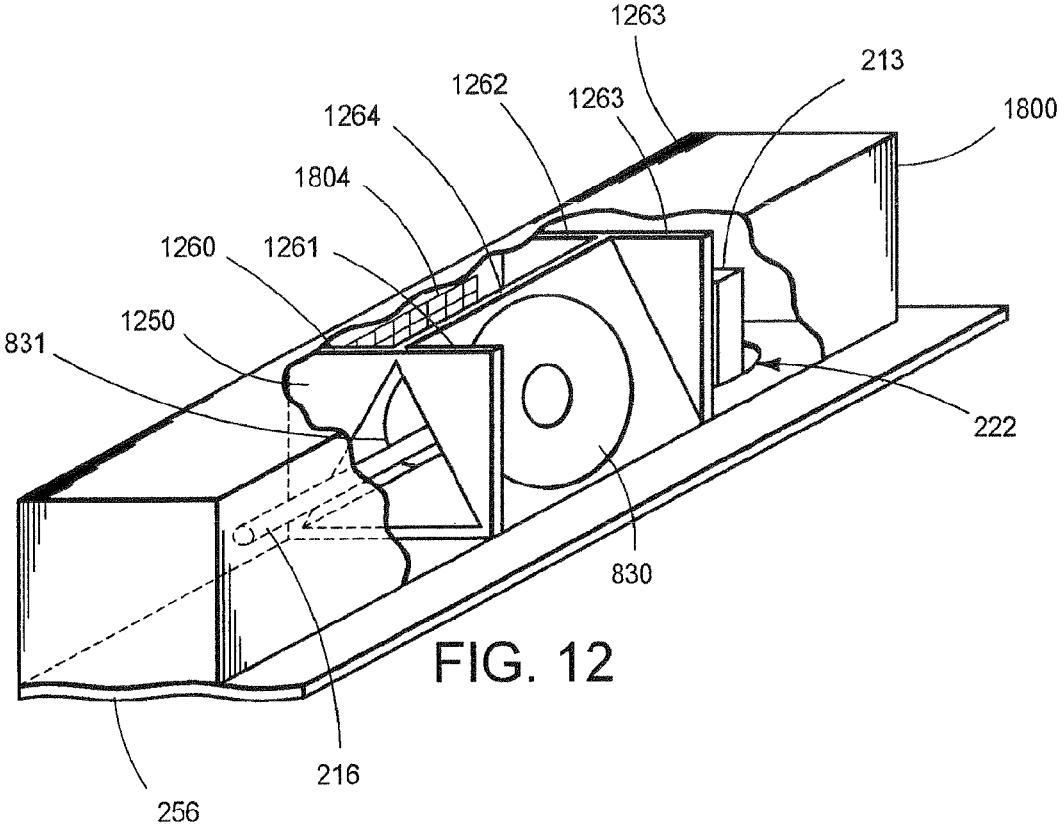
FIG. 12 shows another embodiment of the A-frame design where sound is vented out through grill or vent openings in the sides or roof of the locomotive rather than through openings at the bottom of the A-frame under the engine.

A modification of the A-frame structure is shown in FIG. 12 where only a segment of the engine's body and chassis is drawn. Here the A-frame, 1250 bottom has been sealed up, and the closest end shown has been opened up completely to allow the driveline, 216 and/or other parts of the drive train to pass through unencumbered. The far end of the A-frame should be sealed up as much as possible to prevent the front wave from the two speakers from escaping through the chassis opening, 222, for the gear-tower, 213.

In the embodiment of FIG. 12, the A-frame mounting assembly is sealed below. One end of the structure is opened up to vent the "front wave" into the cab. Back wave is vented outside through the air vent screens on the side of the cab. Alternatively, the front wave can be vented straight down through chassis. The "wings" 1263 on one end of the A-frame seal against the cab sidewall; so the "backwave" vents throughout interior volume of the cab, although it is generally sealed as explained below.

The back of speaker 830 can be seen as before but now the front of the second speaker, 831, can be seen through the A-shaped hole. Also shown is a partial outline of the narrow-bodied locomotive cab, 1800. Decorative vent or grill in the diesel cab, 1804 is shown drawn on one side of the locomotive; the second grill, 1802, is not shown in this figure since it would be part of the removed cutaway cab area. In any case, the vent holes are open to air to allow back wave sound from speakers 830 and 831 to pass directly out through the grills to the outside. The sides of the A-frame ends are extended with wings, 1260, 1261, 1262 and 1263 to the edges of the diesel cab interior which prevents back wave sound from either speaker passing into other parts of the cab area. The front waves from speakers, 830 and 831 can pass to the interior of the cab through the open A-frame end but can no longer vent directly through the bottom of the A-frame to underneath the locomotive. These back waves are prevented from mixing with the speaker's front waves within the cab area by the same wings, 1260, 1261, 1262, and 1263.

In this drawing FIG. 12, the diesel cab and chassis are shown terminated at the closest end 256 in the Figure. However, the chassis continues to the end of the engine and is sealed from allowing the front waves from leaving the enclosed diesel cab and chassis area. This structure allows the front wave to resonate within the closed diesel cab area while preventing the front wave from mixing with the back wave.

This structure has some drawbacks compared to the method described in FIG. 10 since to prevent back and front waves from mixing, the wings, 1260, 1261, 1262 and 1263 as well as the top of the A-frame, must seal well to the sides and top of the diesel cab interior. In addition, it can be difficult to find the best location for this A-frame structure in some locomotive models where the decorative grill or vent openings may be inconveniently located. It is also more difficult to manufacture diesel cabs where the grills are open.

Note that in both structures, FIG. 10 and FIG. 12, we speak of the speaker back wave and front wave where the front wave is considered emanating from the open cone area of the speaker while the back wave is usually thought of emanating from air vent holes near the speaker magnet casing. In both structures, FIG. 10 and FIG. 12, either of the speakers could have been mounted facing in or facing out, provided the speaker housing, magnet casings, etc. would not interfere with the drivelines, flywheels, and diesel cab. The advantage with facing speakers in is that most speakers have electrical connections on the back that make it easier to connect to the electronics. If the speakers face out, the electrical wire connections will likely be on the inside the A-frame, which might interfere with the driveline or flywheel motion.

Figure 13:
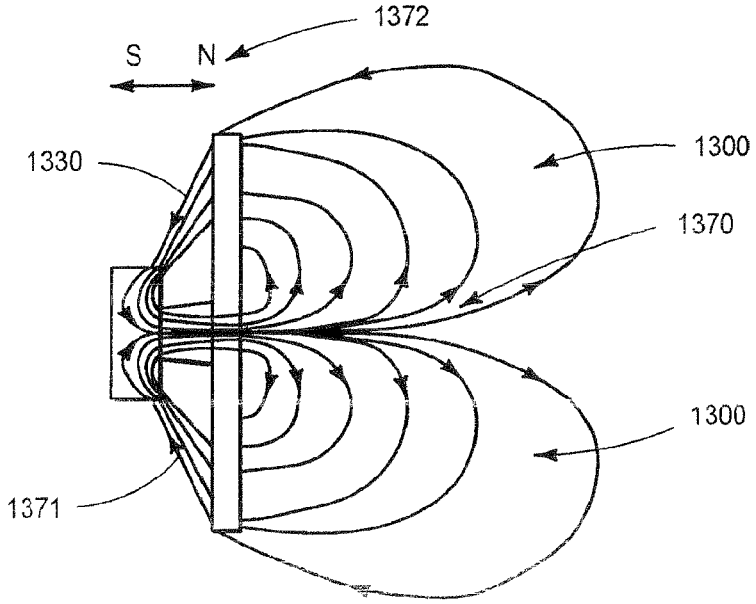
FIG. 13 shows the magnetic field lines from a typical Mylar speaker with most of the magnetic flux from the back contained by the speaker ferromagnetic magnet casing support structure.
Figure 14:
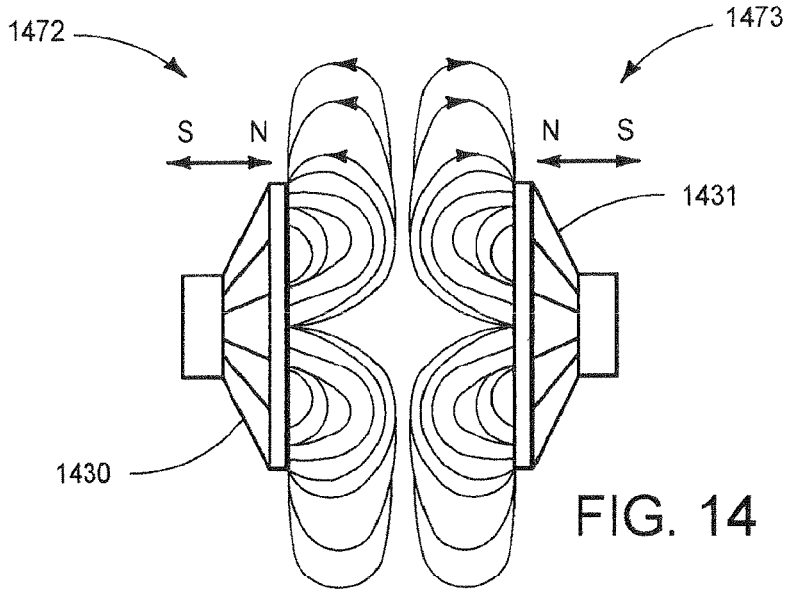
FIG. 14 shows two similar speakers facing each other with their opposing magnetic fields repelling each other.
Figure 15:
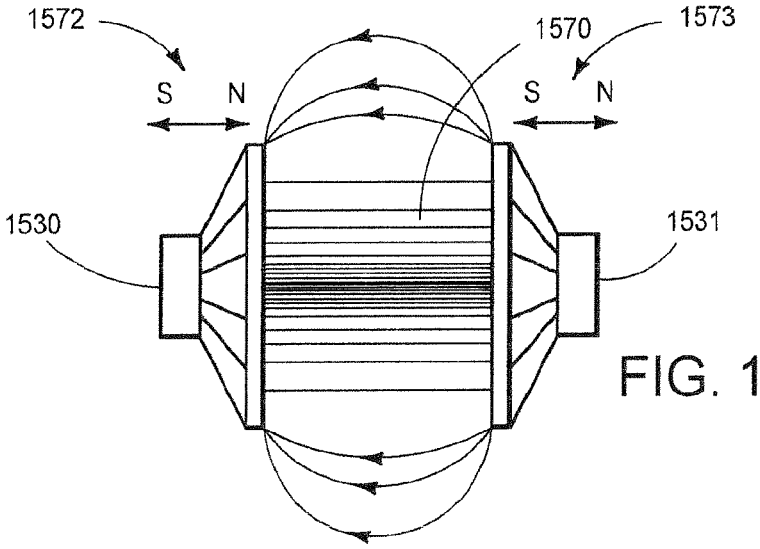
FIG. 15 shows two similar speakers facing each other with the magnet in one of the speakers reversed so the magnetic fields aid each other and attracting the two speakers.

There is also an issue of the speaker stationary magnetic flux from the permanent magnets surrounding the voice coil. Generally, the magnetic field, 1300, runs axially though the center of the speaker cone as shown in FIG. 13. The magnetic field, 1371, from the back pole of the magnet is contained or routed by the low reluctance of the speaker's ferromagnetic voice coil encasement to run along the speaker's structure, 1330 to the edge of the speaker where it joins with the magnetic flux emanating from the center of the speaker cone to form a continuous loop. This improves the magnetic field strength in the voice coil and hence improves the speaker efficiency. The magnetic field direction is irrelevant for the efficiency of an individual speaker but is shown by North-South indicator 1372 for comparative reasons. By convention, magnetic lines of force (B field) emanate from the North Pole and enter the South Pole of a magnet. If two such speakers, 1430 and 1431, are placed face to face, the speaker magnets will repel each other as shown by the magnetic lines of force in FIG. 14. Here indicators 1472 and 1473 show the North-South polarities for speakers 1430 and 1431 respectively. This will decrease the magnetic field in each voice coil and hence will somewhat reduce the speakers' effectiveness. On the other hand, if the magnet in one speaker is reversed, then the fields will attract each other as shown in FIG. 15. Here indicators 1572 and 1573 show the North-South polarities for speakers 1530 and 1531 respectively. This results in higher concentration of magnetic flux through the centers of the speaker's voice coils with return paths for the flux at the edges of the speaker's metal structure and support ring. Note that when the magnet is reversed in one of the speakers, the electrical connections to one of the speaker's voice coils must be reversed to phase both speakers to work together.

Figure 16:
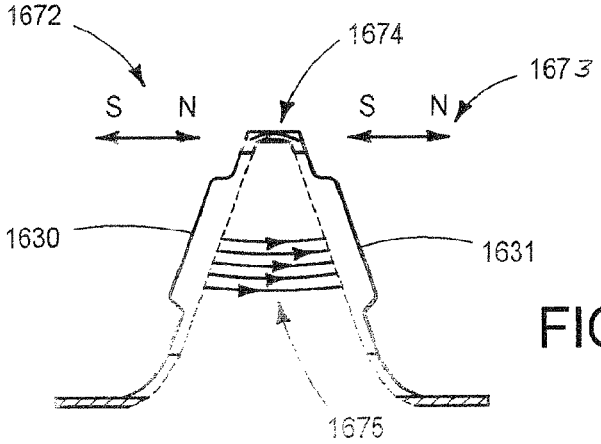
FIG. 16 shows two such attracting speakers mounted in a ferromagnetic A-frame speaker enclosure with enhanced field lines connecting the two speaker backs through the A-frame material and enhanced field strength in the center of the speakers and voice coil area.
Figure 17:
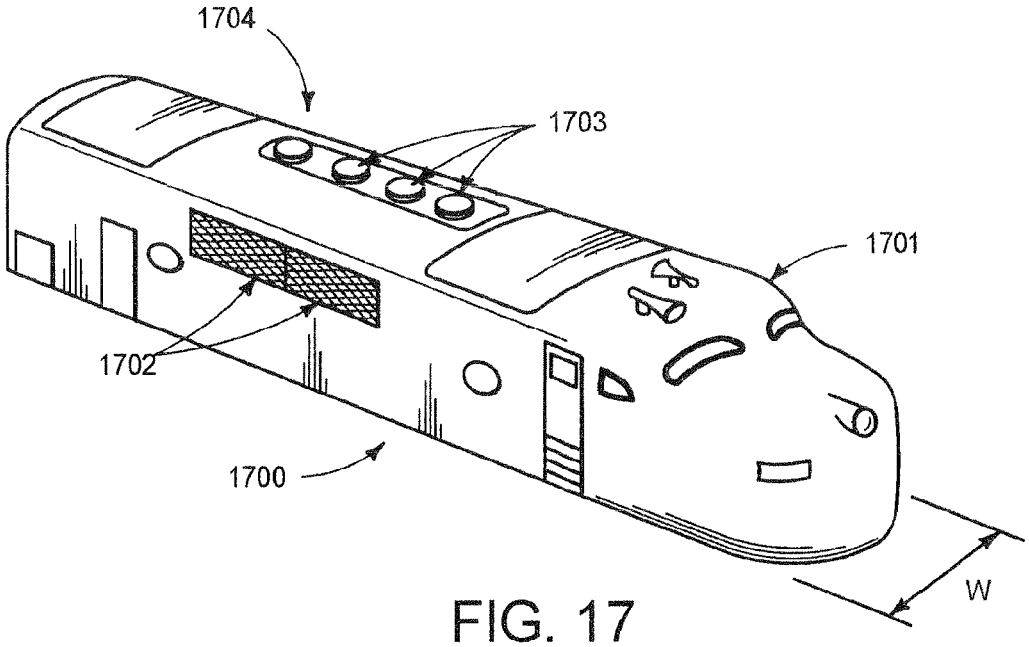
FIG. 17 Prior Art
FIG. 17 (prior art) is a wide-bodied diesel cab.
Figure 18:
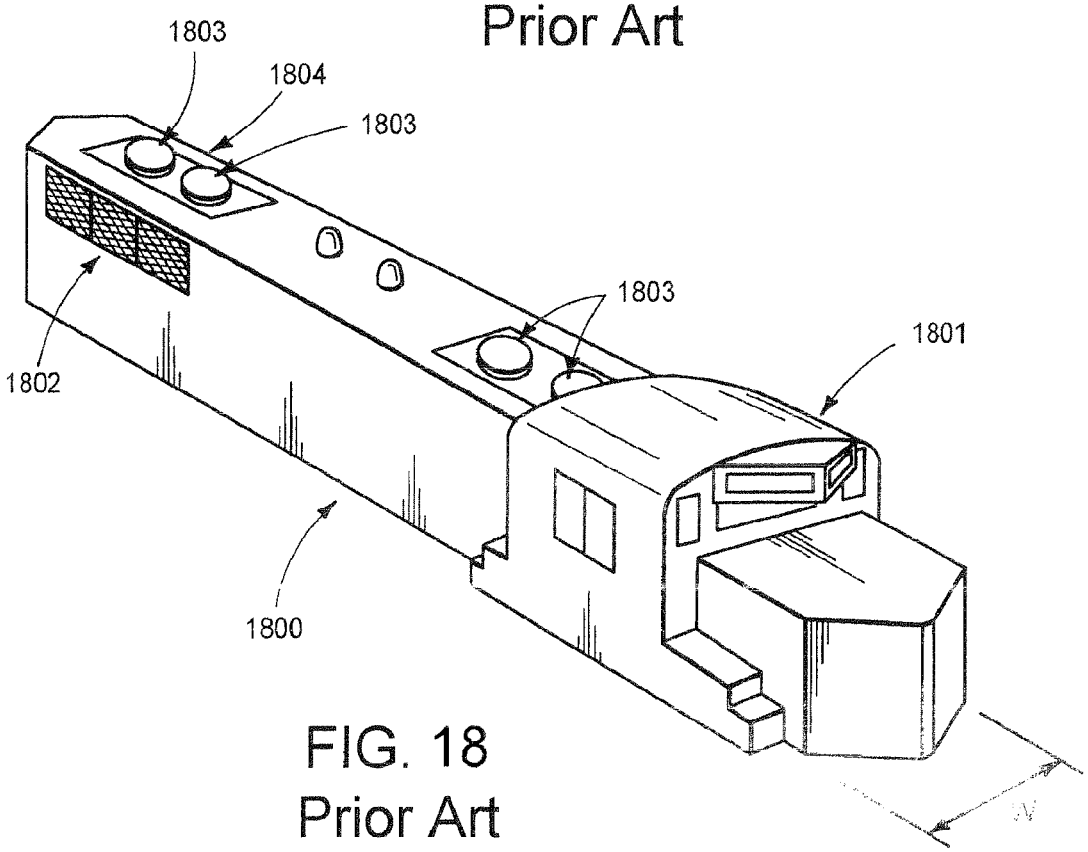
FIG. 18 Prior Art
FIG. 18 (prior art) is a narrow-bodied diesel cab.

In addition, if the A-frame structures shown in FIGS. 8, 10, 11, and 12 are made of ferromagnetic material, and one of the speaker magnets is reversed in polarity as described above, then the magnetic reluctance is reduced for the magnetic path connecting the backs of the two speakers. FIG. 16 is the same as FIG. 11 except that the magnet in 1631 is reversed from the magnet in 1630 as shown by the indicators 1672 and 1673. The field from the back of both speakers now takes the low reluctance path through the ferromagnetic material used for the A-frame structure as shown by the concentrated field 1674 in the upper portion of the A. Actually, magnetic fields will be concentrated anywhere the reluctance is low such as the closed end structure of the A-frame structure shown in FIG. 10. In any case, the overall field strength for the flux, 1675, through the voice coils of speakers 1630 and 1631, are increased for an A-frame made of ferromagnetic material since the high reluctance region is restricted to the air gap between speakers.

Note that in the above A-frame structures, the speakers can be mounted facing out as well as facing in or one speaker can be mounted facing out and the other one facing in. It does not make that much difference in the design of the structures but the wiring to the speakers may need to be changed to ensure proper phasing. However, if the A-frame is constructed of ferromagnetic material, the most efficient design is for both speakers to face each other. It should be noted that the present invention can be applied to all model scales.

Special Installation Methods for Difficult Locomotives:

In order to provide more room for large speakers and electronics in model locomotives, we can use an alternative drive train method. In this case, only one truck is powered from a vertical motor, gear tower or belt drive. Power is coupled to the second truck though a second driveline that passes through end holes in the fuel tank.

Figure 29:
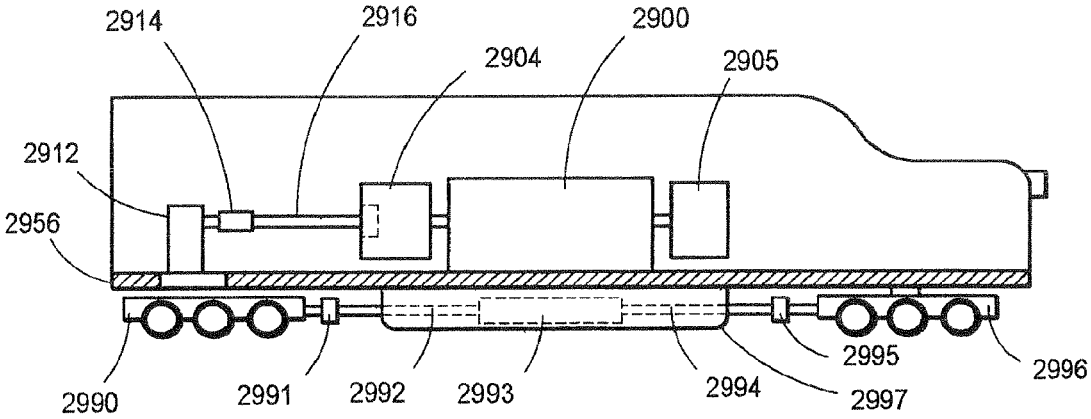
FIG. 29 shows an alternative horizontal drive train method where only one truck is powered from a horizontal motor and gear tower. Power is coupled to the second truck though a second driveline that passes through end holes in the fuel tank.

FIG. 29 shows this method being used with a horizontal drive train. Here the motor, 2900, is connected to two flywheels, 2905 and 2904. A single driveline, 2916 connects to universal joint, 2914, which connects to gear tower, 2912 which powers truck 2990. The other truck receives power from driveline 2992 that connects to truck 2990 through universal joint, 2991. The driveline, 2992 connects to telescoping coupling, 2993, that allows the trucks to rotate freely as they pass through curves but continue to pass torque though to universal joint 2995 and to truck 2996. The fuel tank, 2997, has an internal channel that allows the telescoping coupling, 2993, and two drivelines, 2992 and 2994 to pass through without interference.

Figure 30:
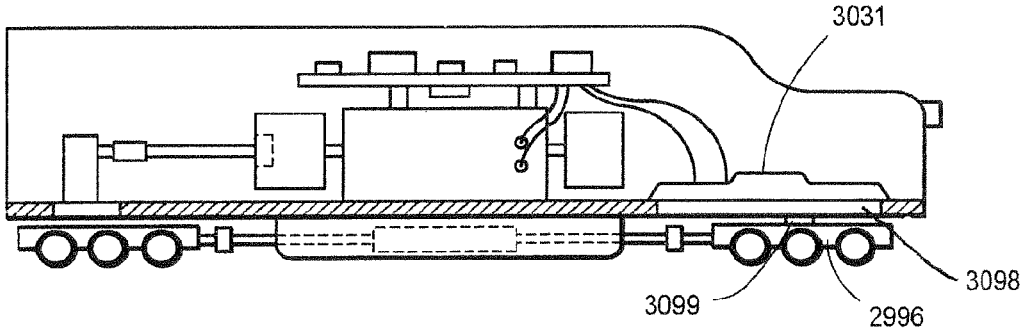
FIG. 30 shows the addition of an electronic soundboard and full-width speaker mounted flat in the area normally used for the second gear tower.

Whether the method to power the first truck is a vertical motor or a horizontal motor, we will call this the "coupled-truck drive train" when a horizontal driveline is connected between the trucks under the locomotive to transfer power. FIG. 30 shows the coupled-truck drive train method used for a wide bodied diesel. The area normally used for the second gear tower is now free for the installation of a full width speaker, 3031, flat on the chassis. The large chassis opening, 3098 allows sound to pass under the locomotive to the open areas in truck, 2996. The truck is mounted to pivot, 3099 that is attached to a bar that is connected to the chassis at the edges.

Figure 31:
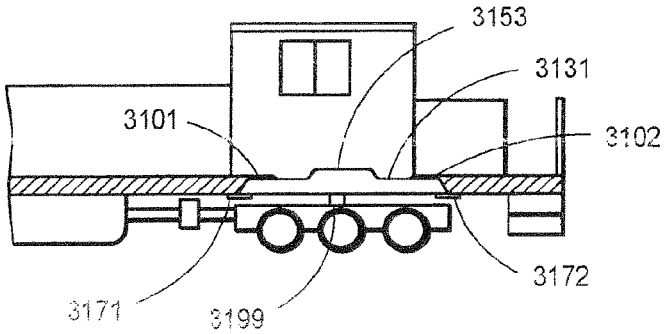
FIG. 31 shows a method to mount a full width speaker mounted flat in a narrow-bodied diesel cab area.

The coupled-truck drive train also has utility for installing full width speakers (slightly smaller diameter than the chassis width) in narrow-body, low-hood locomotives. FIG. 31 shows the front portion of a narrow bodied diesel with the speaker, 3131, being mounted flat in the chassis area in such as way that the speaker magnet housing, 3153 is covered by the engineers cab and the flatter areas of the speaker are partly covered by the chassis at the edges, 3101 and 3102. The cab area is usually not large enough to cover the entire speaker. Mounting the speaker in this way allows the cab to cover the thicker center of the speaker, leave the speaker back wave vents open to the interior of the engine, allow the chassis to cover the edges of the speaker so they cannot be seen from the outside of the engine, and still have a full width speaker to vent sound under the locomotive. In FIG. 31, the speaker is shown mounted from under the chassis and held in place by speaker retainers 3171 and 3172. The truck pivots on support 3199 that connects to the chassis.

Steam Locomotives:

Steam engines usually present fewer problems for sound installation because of the extra room in the tenders as shown by the cross section in FIG. 25. However, having the train sounds come from the tender is not prototypical and with larger engines (e.g., O'Gauge and G'Gauge), it is quite obvious. Even with large HO engines, it is apparent that the sounds are not coming from the correct region of the engine. With some steam engines it is possible to place the speaker in an acoustically sealed steam boiler. FIG. 26 shows a speaker, 2633, placed towards the front of the boiler. The lower smoke box area, 2635, is open to allow the speaker front wave sound to pass under the locomotive in the area of the steam chest. The area, 2601, behind the speaker is acoustically sealed to prevent the back wave from mixing with the front wave.

While this method does allow the sounds to come from the correct area, the sounds are usually much tinnier and lower in volume than the same sounds produced in a suitable tender. A method that may solve both the problems of producing full-bodied sounds and correct sound location is also shown in FIG. 26. Here, a single large base speaker, 2632, is placed in the tender and vented through chassis holes, 2634, to the area under the tender. The electronics board, 2506, supplies only low frequency sounds to the tender speaker and only mid and high frequency sounds to the locomotive speaker, 2633. A simple crossover network could also be used.

Since the human ear is less sensitive to localizing lower frequency sound sources, the locomotive sounds will appear to be coming from the engine. In addition, the base speaker, 2632, will create considerable presence and full-bodied sounds when used in conjunction with the engine speaker, 2633.

Some tenders can be quite small or shaped in ways that can make installation difficult. When appropriate, some of the above methods may be useful for steam engines. In particular, some tender bodies curve in towards the bottom where they connect to the chassis (e.g., Vanderbilt types). In cases like this where speakers cannot be mounted flat on the chassis, speakers can be mounted at a tilt like the speaker shown in FIG. 20. In some rounded tenders, a full width speaker can be mounted on the flat partition that separates the fuel bunker from the water storage area. Either the area under the fuel bunker the water bunker can then be opened to allow sound to vent under the engine, depending on which method sounds better.

It will be obvious to those having skill in the art that many changes may be made to the details of the above-described embodiments without departing from the underlying principles of the invention. The scope of the present invention should, therefore, be determined only by the following claims.

The invention claimed is:

1. A model railroading locomotive comprising:

a horizontal drive train comprising drive train components including an electric motor, a flywheel attached to the motor shaft; a drive line with universal joint(s) and gear tower(s) arranged to transmit torque from the motor shaft to power truck or trucks installed on an underside of the locomotive;

at least one speaker mounted in the locomotive and positioned spaced above at least one of the drive train components;

a speaker enclosure substantially surrounding the speaker and arranged so as to separate a back wave from a front wave of sound emitted by the speaker in use; wherein the speaker enclosure defines a first aperture for venting the front wave to the outside of the locomotive; and wherein the speaker enclosure includes second apertures sized and arranged so as to allow the drive line to extend through the speaker enclosure without interfering with operation of the drive line.

2. A model railroading locomotive according to claim 1 wherein the first aperture exposes the front wave through open areas around the trucks under the locomotive while containing the back wave within the locomotive body.

3. A model railroading locomotive according to claim 1 wherein the first aperture exposes the front wave through at least one aperture in the chassis while containing the back wave within the locomotive body.

* * * * *